US008202057B2

(12) United States Patent
Kohsokabe et al.

(10) Patent No.: US 8,202,057 B2
(45) Date of Patent: Jun. 19, 2012

(54) OIL-FREE SCROLL COMPRESSOR

(75) Inventors: Hirokatsu Kohsokabe, Omitama (JP); Hirotaka Kameya, Tsuchiura (JP); Kazuaki Shiinoki, Yokohama (JP); Toshiaki Yabe, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 219 days.

(21) Appl. No.: 12/542,863

(22) Filed: Aug. 18, 2009

(65) Prior Publication Data

US 2010/0158733 A1 Jun. 24, 2010

(30) Foreign Application Priority Data

Dec. 22, 2008 (JP) ..... 2008-326571

(51) Int. Cl.
*F04B 49/10* (2006.01)

(52) U.S. Cl. ..... 417/13; 417/26; 417/32; 418/55.6

(58) Field of Classification Search ..... 417/13, 417/14, 26, 228, 32; 418/55.6
See application file for complete search history.

(56) References Cited

U.S. PATENT DOCUMENTS

| | | | | | |
|---|---|---|---|---|---|
| 3,413,819 | A * | 12/1968 | Hansen | 62/222 |
| 4,024,909 | A * | 5/1977 | Hofmann, Jr. | 165/297 |
| 4,974,427 | A * | 12/1990 | Diab | 62/505 |
| 5,097,677 | A * | 3/1992 | Holtzapple | 62/500 |
| 5,103,652 | A * | 4/1992 | Mizuno et al. | 62/505 |
| 5,174,741 | A * | 12/1992 | Tohgo | 418/84 |
| 5,195,881 | A * | 3/1993 | George, Jr. | 418/97 |
| 5,447,420 | A * | 9/1995 | Caillat et al. | 418/55.5 |
| 5,640,854 | A * | 6/1997 | Fogt et al. | 62/197 |
| 6,343,482 | B1 * | 2/2002 | Endo et al. | 62/324.6 |
| 7,234,310 | B2 * | 6/2007 | Flynn et al. | 62/114 |
| 2005/0217292 | A1 * | 10/2005 | Onishi et al. | 62/197 |

FOREIGN PATENT DOCUMENTS

| | | | |
|---|---|---|---|
| JP | 08-128395 | | 5/1996 |
| JP | 08128395 | A * | 5/1996 |
| JP | 2002130850 | A * | 5/2002 |

OTHER PUBLICATIONS

JP 08128395 A ;May 1996 ;translation.*
JP 2002130850 A ;May 2002;abstract translation.*
Ke et al., "DSPO Water Injected Scroll Compressor", Prepared for: The Innovation Group, University of Toronto, Revision 7, Apr. 6, 2008.

* cited by examiner

*Primary Examiner* — Devon C Kramer
*Assistant Examiner* — Amene Bayou
(74) *Attorney, Agent, or Firm* — Antonelli, Terry, Stout & Kraus, LLP.

(57) ABSTRACT

An oil-free scroll compressor prevents wraps from being broken and provides improved reliability. The oil-free scroll compressor includes an orbiting scroll member and fixed scroll members, and has compression channels into which water is injected each formed between the intake port and exhaust port provided in the fixed scroll member. The oil-free scroll compressor includes temperature sensors each of which detects temperature in the compression channel, regulating valves each of which controls ratio of the amount of the water to be injected into the respective compression channels to the total amount of the water to be injected into the compression channels, and controller which controls the opening degrees of the regulating valves such that a difference between the detected temperatures from the compression channels is small.

2 Claims, 8 Drawing Sheets

OIL-FREE SCROLL COMPRESSOR

BACKGROUND OF THE INVENTION

1. Field of the Invention

The present invention relates to a scroll compressor that compresses air, and more particularly to an oil-free scroll compressor in which water is injected into a compression chamber instead of oil.

2. Description of the Related Art

An oil-free compressor in which oil (lubricating oil) is not injected into a compression chamber is known as one example of compressors that compress air. The oil-free compressor is essential in the field such as food industry and semiconductor manufacturing processes in which clean compressed air that does not contain oil is required. The oil-free compressor, however, has a lower compression efficiency than an oil feeding compressor that requires oil to be injected into a compression chamber. In addition, the oil-free compressor needs to be subjected to maintenance at a shorter interval compared with the oil feeding compressor. Thus, the oil-free compressor is disadvantageous in terms of performance and reliability. To address such problems, an oil-free screw compressor has been put into practical use, in which water is injected into a compression chamber for high cooling and sealing effects.

Scroll compressors are advantageous in that noise and vibration are low. For example, JP-08-128395-A discloses an oil-free scroll compressor in which water is injected into compression chambers. Such an oil-free scroll compressor is of double scroll type. This type of oil-free scroll compressor includes an orbiting scroll member and two fixed scroll members. The orbiting scroll member has two substantially spiral wraps on both surfaces thereof. One of the fixed scroll members is located on one side of the oil-free scroll compressor. The fixed scroll member has a substantially spiral wrap provided on one surface thereof and corresponding to one of the substantially spiral wraps of the orbiting scroll member. The other of the fixed scroll members is located on the other side of the oil-free scroll compressor. The other fixed scroll member has a substantially spiral wrap provided on one surface thereof and corresponding to the other of the substantially spiral wraps of the orbiting scroll member. The oil-free scroll compressor also has a water injection system. The water injection system injects water through a hole provided in one of the fixed scroll members into a compression chamber that is located on one side of the orbiting scroll member, and injects water through a hole provided in the other of the fixed scroll members into another compression chamber that is located on the other side of the orbiting scroll member. The water injection system has a liquid tank, a pump device, a tube and valve devices. The liquid tank stores water and is connected with the pump device. The tube is divided into two tubes on a discharge side of the pump device. The one of the divided tubes communicates with the hole provided in the one of the fixed scroll members, while the other of the divided tubes communicates with the hole provided in the other of the fixed scroll members. One of the valve devices is installed to the one of the divided tubes, while the other of the valve devices is installed to the other of the divided tubes.

SUMMARY OF THE INVENTION

However, there is the following problem with the aforementioned conventional technique. The oil-free scroll compressor described in JP-08-128395-A includes the water injection system that injects water into the compression chamber located on the one side of the orbiting scroll member and the compression chamber located on the other side of the orbiting scroll member. In JP-08-128395-A, however, there is no clear description of a process for controlling a balance of the amounts of water to be injected into the compression chamber located on one side of the orbiting scroll member and the compression chamber located on the other side of the orbiting scroll member. That is, there is no clear description of a process for controlling a balance of temperatures of the compression chambers. A scroll compressor needs to be compensated due to thermal deformation in terms of its design in many cases, compared with a screw compressor. This results from a difference between compression schemes of the two types of compressors. Thus, the temperature in the compression chamber located on the one side of the orbiting scroll member may become different from that located on the other side of the orbiting scroll member, and thermal deformations may be unbalanced. In such a case, wraps may contact to each other.

In addition, JP-A-H08-128395 does not clearly describe a timing of injecting water when the oil-free scroll compressor starts operating and a timing of stopping injecting water when the oil-free scroll compressor stops operating. Thus, an excessive amount of water may be present and compressed in the compression chambers. As a result, the wraps may be broken.

An object of the present invention is to provide an oil-free scroll compressor adapted to prevent wraps from being broken and provide improved reliability.

(1) To accomplish the above object, an oil-free scroll compressor according to an aspect of the present invention, the compressor including an orbiting scroll member having a substantially spiral wrap, a fixed scroll member having a substantially spiral wrap corresponding to the wrap of the orbiting scroll member, and a motor that generates driving force to cause the orbiting scroll member to rotate with respect to the fixed scroll member, wherein compression channels into which water is injected are each formed between intake port and exhaust port, comprises: temperature detection means for detecting temperatures in at least two compression channels; and water amount control means for controlling the amounts of water to be injected into the respective compression channels, wherein the water amount control means controls the ratio of the amount of the water to be injected into the respective compression channels to the total amount of the water to be injected into the compression channels such that a difference between the temperatures in the compression channels detected by the temperature detection means is small.

According to the aspect of the present invention, the oil-free scroll compressor detects the temperatures in at least two compression channels (in detail, two compression channels formed at both side of orbiting scroll member of the double scroll type oil-free scroll compressor, or two compression channels formed on radial inner side and outer side of the wrap of the orbiting scroll member), and adjusts ratio of the amount of the water to be injected into the respective compression channels to the total amount of the water to be injected into the compression channels such that the difference between the detected temperatures from the compression channels is small. Since the difference between the temperatures in the compression channels is small, the oil-free scroll compressor can maintain a balance of thermal deformations to prevent wraps from contacting each other. Accordingly, the oil-free scroll compressor can prevent the wraps from being broken and provide improved reliability.

(2) In the oil-free scroll compressor according to the aspect of the present invention, it is preferable that the temperature detection means includes a temperature sensor that outputs an electric signal indicative of the detected temperatures from the at least two compression channels, and that the water amount control means includes a regulating valve and a controller, the regulating valve being adapted to control the ratio of the amount of the water to be injected into the respective compression channels to the total amount of the water to be injected into the compression channels, the controller being adapted to calculate an opening degree of the regulating valve such that a difference between the detected temperatures from the compression channels is small, generate a control signal based on the calculation, and output the control signal to the regulating valve to control the regulating valve.

(3) In the oil-free scroll compressor according to the aspect of the present invention, it is preferable that the temperature detection means includes two sensing bulbs in each of which working gas which detects the temperature in the compression channel is enclosed, and that the water amount control means includes an automatic regulating valve in which a valve body is operated due to a pressure difference between the working gases each introduced from the two sensing bulbs to control the ratio of the amount of the water to be injected into the respective compression channels to the total amount of the water to be injected into the compression channels such that the difference between the detected temperatures from the two compression channels is small.

(4) In the oil-free scroll compressor according to the aspects of the present invention, it is preferable that the compressor further comprise motor control means that starts driving the motor in response to an instruction to start an operation of the oil-free scroll compressor, wherein the water amount control means starts a water injection into the compression channels when a predetermined time elapses after the start of the drive of the motor performed by the motor control means.

During the initial period of the operation of the oil-free scroll compressor, the temperatures in the compression channels are normally low. Therefore, when a start of water injection into the compression channels is performed simultaneous with a start of motor driving in response to an instruction to start the operation of the oil-free scroll compressor, an excessive amount of water (liquid) may remain in the compression channels and be compressed. This may cause the wraps to be broken. According to the present invention, when the predetermined time elapses after the motor starts being driven, that is, after the temperatures in the compression channels sufficiently increase, the injection of the water into the compression channels starts. Thus, the oil-free scroll compressor can prevent the wraps from being broken without an excessive amount of water remaining in the compression channels. The oil-free scroll compressor can provide improved reliability.

(5) In the oil-free scroll compressor according to the aspects of the present invention, it is preferable that the compressor further comprise motor control means that stops driving the motor when a predetermined time elapses after the water amount control means stops a water injection into the compression channels in response to an instruction to terminate an operation of the oil-free scroll compressor.

When a stop of motor driving is performed simultaneous with a stop of water injection into the compression channels in response to the instruction to terminate the operation of the oil-free scroll compressor, an excessive amount of water (liquid) may remain in the compression channels. If the oil-free scroll compressor starts operating under the condition that the excessive amount of the water (liquid) may remain in the compression channels, the oil-free scroll compressor may cause the water to be compressed and thereby cause the wraps to be broken. According to the present invention, however, after the injection of the water into the compression channels stops and the predetermined time then elapses, that is, the water present in the compression channels is sufficiently removed, the motor stops being driven. Thus, the oil-free scroll compressor can prevent the wraps from being broken due to the liquid compression without an excessive amount of water remaining in the compression channels and therefore provide improved reliability.

(6) To accomplish the object of the present invention, an oil-free scroll compressor according to another aspect of the present invention, the compressor including an orbiting scroll member having a substantially spiral wrap, a fixed scroll member having a substantially spiral wrap corresponding to the wrap of the orbiting scroll member, and a motor that generates driving force to cause the orbiting scroll member to rotate with respect to the fixed scroll member, wherein compression channels into which water is injected are each formed between intake port and exhaust port, comprises: motor control means that starts driving the motor in response to an instruction to start an operation of the oil-free scroll compressor; and water amount control means that starts a water injection into the compression channels when a predetermined time elapses after the start of the drive of the motor performed by the motor control means.

(7) To accomplish the object of the present invention, an oil-free scroll compressor according to still another aspect of the present invention, the compressor including an orbiting scroll member having a substantially spiral wrap, a fixed scroll member having a substantially spiral wrap corresponding to the wrap of the orbiting scroll member, and a motor that generates driving force to cause the orbiting scroll member to rotate with respect to the fixed scroll member, wherein compression channels into which water is injected are each formed between intake port and exhaust port, comprises: water amount control means that stops a water injection into the compression channels in response to an instruction to terminate an operation of the oil-free scroll compressor; and motor control means that stops driving the motor when a predetermined time elapses after the stop of a water injection into the compression channels performed by the water amount control means.

According to the present invention, the oil-free scroll compressor can prevent the wraps from being broken and provide improved reliability.

DESCRIPTION OF THE PREFERRED EMBODIMENTS

Embodiments of the present invention are described below with reference to the accompanying drawings.

Figure 1:
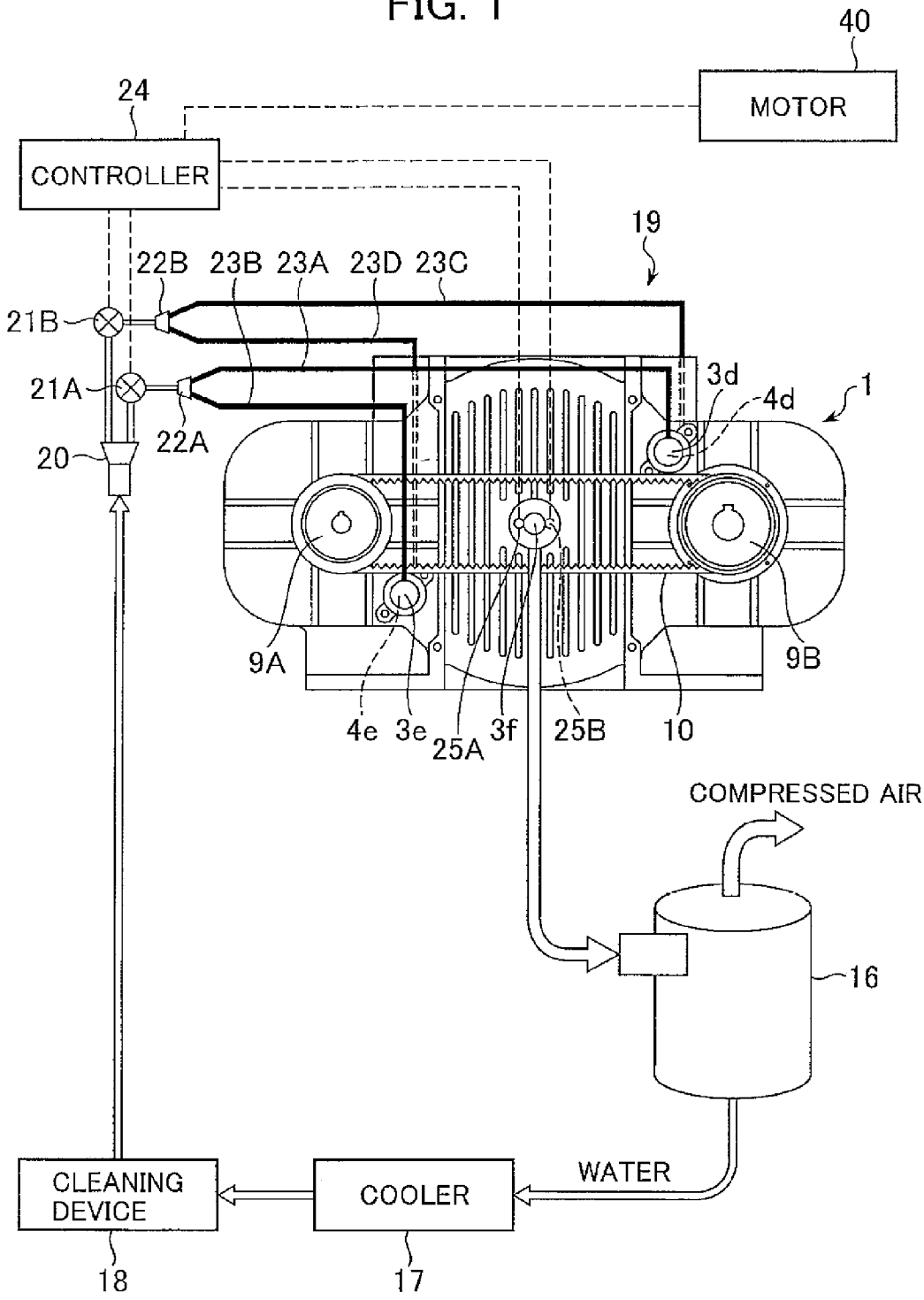
FIG. 1 is an outline diagram showing the entire configuration of an oil-free scroll compressor according to the first embodiment of the present invention.
Figure 2:
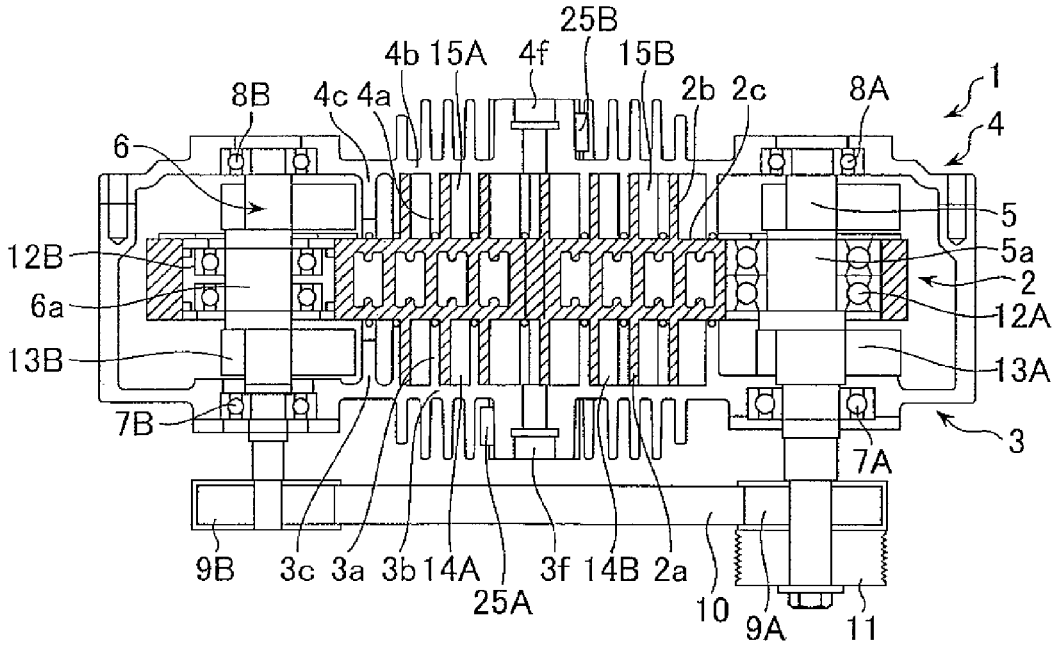
FIG. 2 is a horizontal cross sectional view of a compression body included in the oil-free scroll compressor according to the first embodiment and temperature sensors arranged in the compression body.
Figure 3:
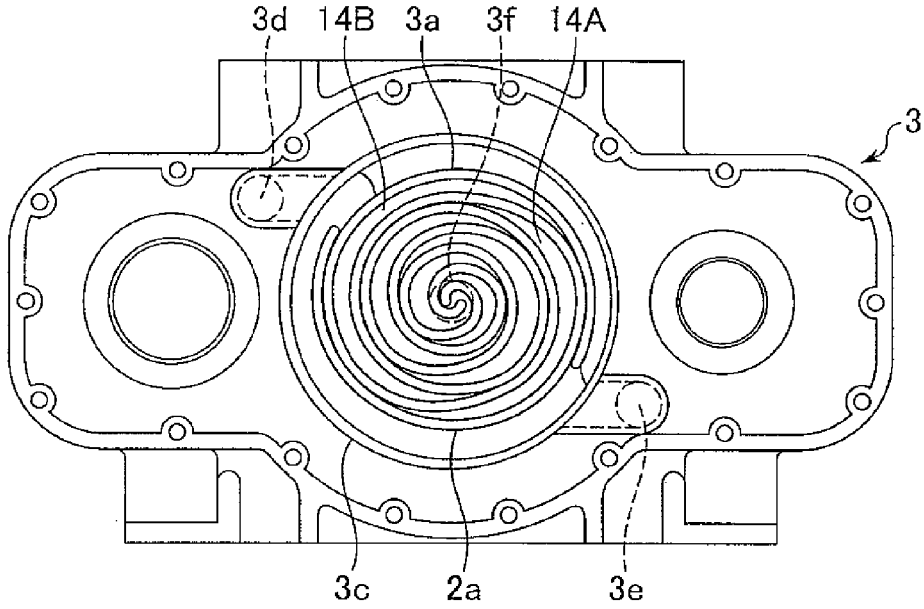
FIG. 3 is a back side view of a fixed scroll member forming a part of the compression body according to the first embodiment.

FIG. 1 is an outline diagram showing the entire configuration of an oil-free scroll compressor according to the first embodiment of the present invention. In FIG. 1, a compressor body 1 is illustrated by viewing from the front side thereof. FIG. 2 is a horizontal cross sectional view of a detail structure of the compressor body 1 with temperature sensors 25A and 25B arranged in the compressor body 1. FIG. 3 is a back side view of a fixed scroll member 3 forming a part of the compressor body (and also shows a wrap 2*a* of an orbiting scroll member 2 included in the compressor body, for convenience sake).

In FIGS. 1 to 3, the oil-free scroll compressor includes the compressor body 1 and a water injection system (described later). The compressor body 1 is driven by a motor 40 to compress air. The compression body 1 includes compression chambers. The water injection system injects water into the compression chambers included in the compression body 1, and also separates and collects moisture from the compressed air discharged from the compression body 1. The water injection system injects the water into the compression chambers of the compressor body 1 in this way to improve cooling and sealing effects.

The compressor body 1 is of double scroll type. The compressor body 1 includes the orbiting scroll member 2, the fixed scroll member 3 and a fixed scroll member 4. The orbiting scroll member 2 includes the substantially spiral wrap 2*a*, a substantially spiral wrap 2*b* and an end plate 2*c*. The wrap 2*a* is located on one surface (located on the lower side of FIG. 2) of the end plate 2*c*, while the wrap 2*b* is located on other surface (located on the upper side of FIG. 2) of the end plate 2*c*. The fixed scroll member 3 has a substantially spiral wrap 3*a* and an end plate 3*b*. The wrap 3*a* corresponds to the wrap 2*a* of the orbiting scroll member 2. Specifically, the wrap 3*a* is not in contact with the wrap 2*a* and interlocks with the wrap 2*a*. The wrap 3*a* is located on one surface (located on the upper side of FIG. 2) of the end plate 3*b*. The fixed scroll member 4 has a substantially spiral wrap 4*a* and an end plate 4*b*. The wrap 4*a* corresponds to the wrap 2*b* of the orbiting scroll member 2. Specifically, the wrap 4*a* is not in contact with the wrap 2*b* and interlocks with the wrap 2*b*. The wrap 4*a* is located on one surface (located on the lower side of FIG. 2) of the end plate 4*b*. The fixed scroll members 3 and 4 are combined with each other and form a housing having the orbiting scroll member 2 therein.

The compressor body 1 also has a main crank shaft 5 and an auxiliary crank shaft 6, which cause the orbiting scroll member 2 to rotate with respect to the fixed scroll members 3 and 4. The fixed scroll member 3 includes shaft bearings 7A and 7B, while the fixed scroll member 4 includes shaft bearings 8A and 8B. The main crank shaft 5 is rotatably held by the shaft bearings 7A and 8A. The auxiliary shaft 6 is rotatably held by the shaft bearings 7B and 8B. The main crank shaft 5 and the auxiliary crank shaft 6 have respective shaft edge portions protrude from the fixed scroll member 3. A pulley 9A is installed to the shaft edge portion of the main crank shaft 5, while a pulley 9B is installed to the shaft edge portion of the auxiliary crank shaft 6. A timing belt 10 is installed to the pulleys 9A and 9B such that the main crank shaft 5 and the auxiliary crank shaft 6 rotate in a synchronized manner. A V pulley 11 is installed to the shaft edge portion of the main crank shaft 5. Another V pulley (not shown) is installed to a shaft of the motor 40. A V belt (not shown) is installed between the V pulley 11 and the V pulley installed to the shaft of the motor 40 to transfer rotation power of the motor 40 to the main crank shaft 5.

The main crank shaft 5 has a crank portion 5*a* connected to a part of a radial outer circumferential portion of the orbiting scroll member 2 on one side thereof (on the right side in FIG. 2). The auxiliary crank shaft 6 has a crank portion 6*a* connected to another part of the radial outer circumferential portion of the orbiting scroll member 2 on the opposite side thereof (on the left side in FIG. 2). The crank portion 5*a* of the main crank shaft 5 and the crank portion 6*a* of the auxiliary crank shaft 6 are decentered by the same amount from an axis of the main crank shaft 5 and an axis of the auxiliary crank shaft 6, respectively. The orbiting scroll member 2 is rotatably held at the crank portions 5*a* and 6*a* through shaft bearings 12A and 12B. The main crank shaft 5 and the auxiliary crank shaft 6 have a balance weight 13A and a balance weight 13B, respectively, in order to offset an unbalance caused by the rotating movement of the orbiting scroll member 2.

The fixed scroll member 3 includes the wrap 3*a*, the end plate 3*b*, a dust wrap 3*c*, two intake ports 3*d* and 3*e*, and an exhaust port 3*f*. The dust wrap 3*c* is located on the radial outer side of the wrap 3*a* with respect to the end plate 3*b* and has a substantially circular shape. The intake ports 3*d* and 3*e* communicate a radial inner portion of the dust wrap 3*c* (or a radial outer portion of the wrap 3*a*) with the external of the oil-free scroll compressor. The exhaust port 3*f* communicates a radial central portion of the wrap 3*a* with the external of the oil-free scroll compressor. The rotating movement of the orbiting scroll member 2 causes air to be sucked from the intake port 3*d* and causes the sucked air to be compressed and discharged from the exhaust port 3*f*. As a result, a compression channel 14A is formed between the orbiting scroll member 2 and the fixed scroll member 3. The compression channel 14A is constituted by a plurality of compression chambers that is formed on a radial inner side of the wrap 2*a* of the orbiting scroll member 2. The compression chambers of the compression channel 14A move to the exhaust port 3*f* due to the rotating movement of the orbiting scroll member 2, while the volumes of the compression chambers of the compression channel 14A are reduced. In addition, the rotating movement of the orbiting scroll member 2 causes air to be sucked from the intake port 3*e* and causes the sucked air to be compressed and discharged from the exhaust port 3*f*. As a result, a compression channel 14B is formed between the orbiting scroll member 2 and the fixed scroll member 3. The compression channel 14B is constituted by a plurality of compression chambers that is formed on a radial outer side of the wrap 2*a* of the orbiting scroll member 2. The compression chambers of the compression channel 14B move to the exhaust port 3*f* due to the rotating movement of the orbiting scroll member 2, while the volumes of the compression chambers of the compression channel 14B are reduced.

The fixed scroll member 4 includes the wrap 4*a*, the end plate 4*b*, a dust wrap 4*c*, two intake ports 4*d* and 4*e*, and an exhaust port 4*f*. The dust wrap 4*c* is located on the outer side of the wrap 4*a* and has a substantially circular shape. The intake ports 4*d* and 4*e* communicate a radial inner portion of the dust wrap 4*c* (or a radial outer portion of the wrap 4*a*) with the external of the oil-free scroll compressor. The exhaust port 4*f* communicates a radial central portion of the wrap 4*a* with the external of the oil-free scroll compressor. The rotating movement of the orbiting scroll member 2 causes air to be sucked from the intake port 4*d* and causes the sucked air to be compressed and discharged from the exhaust port 4*f*. As a result, a compression channel 15A is formed between the orbiting scroll member 2 and the fixed scroll member 4. The compression channel 15A is constituted by a plurality of compression chambers that is formed on a radial inner side of the wrap 2*b* of the orbiting scroll member 2. The compression chambers of the compression channel 15A move to the exhaust port 4*f* due to the rotating movement of the orbiting scroll member 2, while the volumes of the compression chambers of the compression channel 15A are reduced. In addition, the rotating movement of the orbiting scroll member 2 causes air to be sucked from the intake port 4*e* and causes the sucked air to be compressed and discharged from the exhaust port 4*f*. As a result, a compression channel 15B is formed between the orbiting scroll member 2 and the fixed scroll member 4. The compression channel 15B is constituted by a plurality of compression chambers that is formed on a radial outer side of the wrap 2*b* of the orbiting scroll member 2. The compression chambers of the compression channel 15B move to the exhaust port 4*f* due to the rotating movement of the orbiting scroll member 2, while the volumes of the compression chambers of the compression channel 15B are reduced.

The water injection system according to the present embodiment includes a water separator 16, a cooler 17, a cleaning device 18 and a water injector 19. The water separator 16 separates and collects moisture from the compressed air discharged from the exhaust ports 3*f* and 4*f* of the compression body 1. The cooler 17 cools the water collected by the water separator 16. The cleaning device 18 removes a toxic component from the water cooled by the cooler 17. The water injector 19 injects the water cleaned and supplied by the cleaning device 18 into the compression channels 14A, 14B, 15A and 15B.

The water injector 19 includes distributors 20, 22A and 22B, injector pipes 23A, 23B, 23C and 23D, and regulating valves 21A and 21B. The distributor 20 has outlet ports. The distributor 22A has outlet ports. The distributor 22B has outlet ports. One of the outlet ports of the distributor 20 is connected with the regulating valve 21A, while the other of the outlet ports of the distributor 20 is connected with the regulating valve 21B. The distributor 20 distributes, to the regulating valves 21A and 21B, the water supplied from the cleaning device 18. The distributor 22A is connected with the one of the outlet ports of the distributor 20 via the regulating valve 21A. The distributor 22B is connected with the other of the outlet ports of the distributor 20 via the regulating valve 21B. The distributor 22A receives the water from the distributor 20 via the regulating valve 21A. The distributor 22A distributes part of the water to the intake port 3*d* via the injector pipe 23A and distributes the other part of the water to the intake port 3*e* via the injector pipe 23B. The distributor 22B receives the water from the distributor 20 via the regulating valve 21B. The distributor 22B distributes part of the water to the intake port 4*d* via the injector pipe 23C and distributes the other part of the water to the intake port 4*e* via the injector pipe 23D. The injector pipe 23A is connected with one of the outlet ports of the distributor 22A such that the water is injected from the one of the outlet ports of the distributor 22A to the intake port 3*d*. In other words, the injector pipe 23A is connected with the one of the outlet ports of the distributor 22A such that the water is injected from the one of the outlet ports of the distributor 22A to the compression channel 14A. The injector pipe 23B is connected with the other of the outlet ports of the distributor 22A such that the water is injected from the other of the outlet ports of the distributor 22A to the intake port 3*e*. In other words, the injector pipe 23B is connected with the other of the outlet ports of the distributor 22A such that the water is injected from the other of the outlet ports of the distributor 22A to the compression channel 14B. The injector pipe 23C is connected with one of the outlet ports of the distributor 22B such that the water is injected from the one of the outlet ports of the distributor 22B to the intake port 4*d*. In other words, the injector pipe 23C is connected with the one of the outlet ports of the distributor 22B such that the water is injected from the one of the outlet ports of the distributor 22B to the compression channel 15A. The injector pipe 23D is connected with the other of the outlet ports of the distributor 22B such that the water is injected from the other of the outlet ports of the distributor 22B to the intake port 4*e*. In other words, the injector pipe 23D is connected with the other of the outlet ports of the distributor 22B to ensure that the water is injected from the other of the outlet ports of the distributor 22B to the compression channel 15B. The oil-free scroll compressor shown in FIG. 1 includes a controller 24 which controls the opening degrees of the regulating valves 21A and 21B to adjust a ratio of the amounts of the water to be injected into the compression channels 14A and 14B to the amounts of the water to be injected into the compression channels 15A and 15B.

The temperature sensor 25A is located in the vicinity of the exhaust port 3*f* of the fixed scroll member 3. The temperature sensor 25A detects the temperature of the compression channel 14A via the end plate 3*b*, for example. The temperature of the compression channel 14A means the temperature of air present in the compression chamber located most closely to a location at which the compression channel 14A communicates with the exhaust port 3*f*. The temperature sensor 25A outputs a signal (electric signal) indicative of the detected temperature. The temperature sensor 25B is located in the vicinity of the exhaust port 4*f* of the fixed scroll member 4. The temperature sensor 25B detects the temperature of the compression channel 15B via the end plate 4*b*, for example. The temperature of the compression channel 15B means the temperature of air present in the compression chamber located most closely to a location at which the compression channel 15B communicates with the exhaust port 4*f*. The temperature sensor 25B outputs a signal (electric signal) indicative of the detected temperature.

Figure 4:
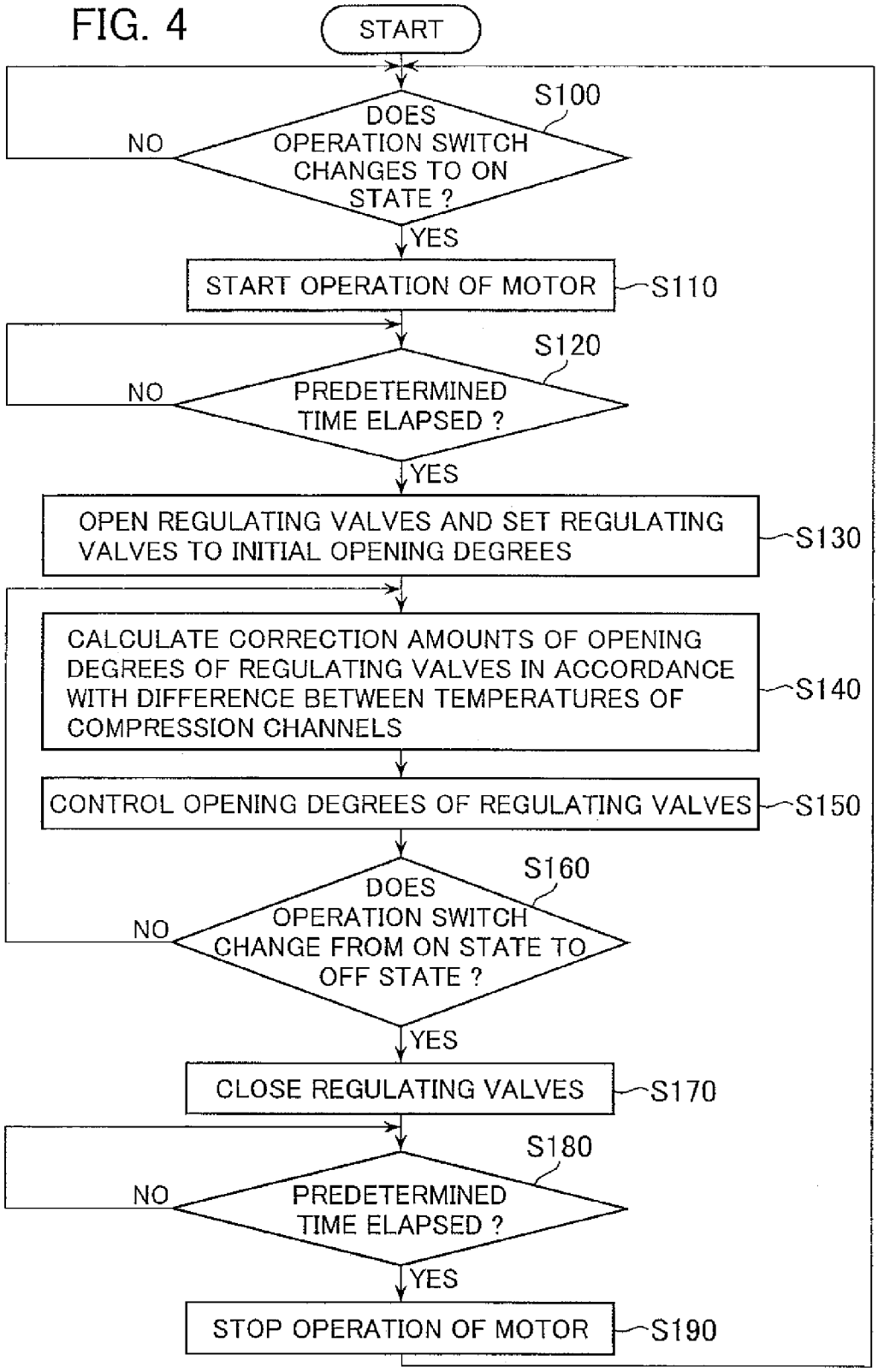
FIG. 4 is a flowchart of a control process performed by a controller according to the first embodiment.

The controller 24 has first and second control functions. To perform the first control function, the controller 24 receives the signals from the temperature sensors 25A and 25B, and then calculates the opening degrees of the regulating valves 21A and 21B based on the received signals such that a difference between the temperature of the compression channel 14A and the temperature of the compression channel 15B is small. After that, the controller 24 generates control signals based on the calculation, and then outputs the signals to the regulating valves 21A and 21B to control the opening degrees of the regulating valves 21A and 21B. To perform the second control function, the controller 24 controls the regulating valves 21A and 21B and the motor 40 in response to an ON/OFF signal (signal instructing the oil-free scroll compressor to start or terminate an operation) received from an operation switch (not shown), for example. FIG. 4 is a flowchart of the control process performed by the controller 24.

The controller 24 first determines in step 100 whether or not the operation switch changes from an OFF state to an ON state as shown in FIG. 4. When the operation switch does not change from the OFF state to the ON state, the requirement for the determination in step 100 is not satisfied, and step 100 is repeated. On the other hand, when the operation switch changes from the OFF state to the ON state, the determination in step 100 is satisfied, and the process proceeds to step 110. In step 110, the operation of the motor 40 starts. The process then proceeds to step 120, at which the controller 24 determines whether or not a predetermined time (approximately several ten seconds) elapses after the start of the operation of the motor 40. Until the predetermined time elapses, the requirement for the determination in step 120 is not satisfied, and step 120 is repeated. When the predetermined time elapses, the determination in step 120 is satisfied and the process proceeds to step 130. In step 130, the regulating valves 21A and 21B change from closed states to opening states (in which the regulating valves are open with preset initial opening degrees).

The process then proceeds to step 140. In step 140, the controller 24 calculates the difference between the temperature of the compression channel 14A and the temperature of the compression channel 15B based on the signals received from the temperature sensors 25A and 25B. The controller 24 calculates correction amounts of the opening degrees of the regulating valves 21A and 21B such that the difference is small. After that, the process proceeds to step 150. The controller 24 then generates control signals based on the calculation and outputs the control signals to the regulating valves 21A and 21B to control the opening degrees of the regulating valves 21A and 21B. Specifically, when the temperature of the compression channel 14A is higher than that of the compression channel 15B, the opening degree of the regulating valve 21A is increased in accordance with the temperature difference, or the opening degree of the regulating valve 21B is reduced in accordance with the temperature difference. As a result, the amounts of the water that is to be injected into the compression channels 14A and 14B increase, or the amounts of the water that is to be injected into the compression channels 15A and 15B are reduced. When the temperature of the compression channel 15B is higher than that of the compression channel 14A, the opening degree of the regulating valve 21B is increased in accordance with the temperature difference, or the opening degree of the regulating valve 21A is reduced in accordance with the temperature difference. As a result, the amounts of the water that is to be injected into the compression channels 15A and 15B increase, or the amounts of the water that is to be injected into the compression channels 14A and 14B are reduced.

After that, the process proceeds to step 160. The controller 24 determines whether or not the operation switch changes from the ON state to the OFF state, in step 160. When the operation switch does not change from the ON state to the OFF state, the requirement for the determination in step 160 is not satisfied, and steps 140 and 150 are repeated. When the operation switch changes from the ON state to the OFF state, the requirement for the determination in step 160 is satisfied and the process proceeds to step 170. The regulating valves 21A and 21B change from the opening states to the closed states, in step 170. The process then proceeds to step 180. The controller 24 determines whether or not a predetermined time (several ten seconds) elapses after the regulating valves 21A and 21B are closed (or after the injection of water into the compression channels 14A, 14B, 15A and 15B stops) in step 180. Until the predetermined time elapses, the requirement for the determination in step 180 is not satisfied, and step 180 is repeated. When the predetermined time elapses, the requirement for the determination in step 180 is satisfied, and the process proceeds to step 190. The motor 40 stops operating in step 190. After that, the process proceeds back to step 100, and the same procedure is repeated.

The thus configured oil-free scroll compressor according to the present embodiment detects the temperatures of the compression channels 14A and 15B, and then controls a ratio of the amounts of the water to be injected into the compression channels 14A and 14B to the amounts of the water to be injected into the compression channels 15A and 15B such that the difference between the detected temperatures is small. Thus, the oil-free scroll compressor can maintain a balance of thermal deformations and prevent the wraps from being in contact with each other, by reducing differences among the temperatures of the compression channels 14A, 14B, 15A and 15B. Therefore, the oil-free scroll compressor can prevent the wraps from being broken to provide improved reliability. Furthermore, as gaps between the orbiting scroll member 2 and the fixed scroll members 3 and 4 can be small, the oil-free scroll compressor provides improved compression performance.

Furthermore, to start the operation of the oil-free scroll compressor according to the present embodiment, the motor 40 starts driving the oil-free scroll compressor. The predetermined time elapses after the start of the drive of the motor 40. That is, the temperatures of the compression channels 14A, 14B, 15A and 15B sufficiently increase. After that, the compressor starts the injection of the water into the compression channels 14A, 14B, 15A and 15B. To terminate the operation of the oil-free scroll compressor, the injection of the water into the compression channels 14A, 14B, 15A and 15B stops. The predetermined time elapses after the stop of the injection. After that, the water remaining in the compression channels 14A, 14B, 15A and 15B is sufficiently removed. Then, the motor 40 stops operating. Thus, the oil-free scroll compressor can prevent an excessive amount of water from remaining in the compression channels and prevent the wraps from being broken due to liquid compression. Thus, the oil-free scroll compressor according to the present embodiment has improved reliability.

Figure 5:
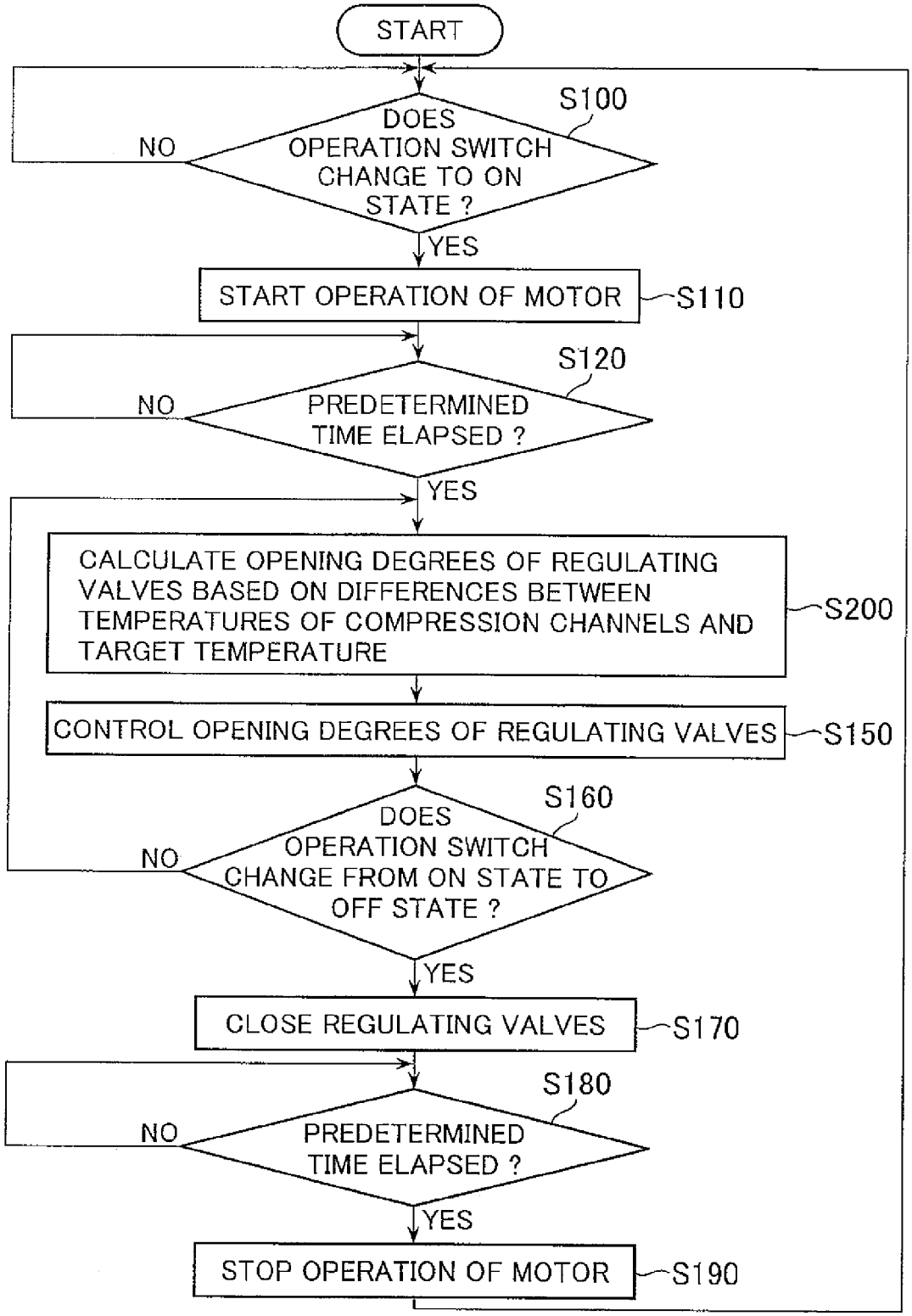
FIG. 5 is a flowchart of a control process performed by a controller according to a modification of the first embodiment.

In the first embodiment, as shown in step 130 to step 150 in FIG. 4 described above, the controller 24 calculates the difference between the temperature of the compression channel 14A and the temperature of the compression channel 15B, calculates the correction amounts of the opening degrees of the regulating valves 21A and 21B such that the difference is small, generates the control signals based on the calculation, and outputs the control signals to the regulating valves 21A and 21B to control the opening degrees of the regulating valves 21A and 21B. The first embodiment is not limited to this. The controller 24 may store data indicative of a predetermined target temperature, calculate a difference between the detected temperature from the compression channel 14A and the target temperature, control the opening degree of the regulating valve 21A such that the difference between the detected temperature from the compression channel 14A and the target temperature is small, calculate a difference between the detected temperature from the compression channel 15B and the target temperature, and control the opening degree of the regulating valve 21B such that the difference between the detected temperature from the compression channel 15B and the target temperature is small, as shown in step 200 and step 150 in FIG. 5. In this case, the difference between the temperature of the compression channel 14A and the temperature of the compression channel 15B is small, and the same effect as describe above can be obtained.

In the first embodiment, the temperature sensors 25A and 25B are provided to detect the temperatures in the compression channels 14A and 15B, respectively, and the water injector 19 is configured to adjust the ratio of the amounts of the water to be injected into the compression channels 14A and 14B to the amounts of the water to be injected into the compression channels 15A and 15B. The first embodiment is not limited to that. The number of temperature sensors, the configurations of the compression channels in which temperatures are objective to be sensed by the temperature sensors, and the configuration of the water injector may be changed without departing from the scope of the present invention.

Figure 6:
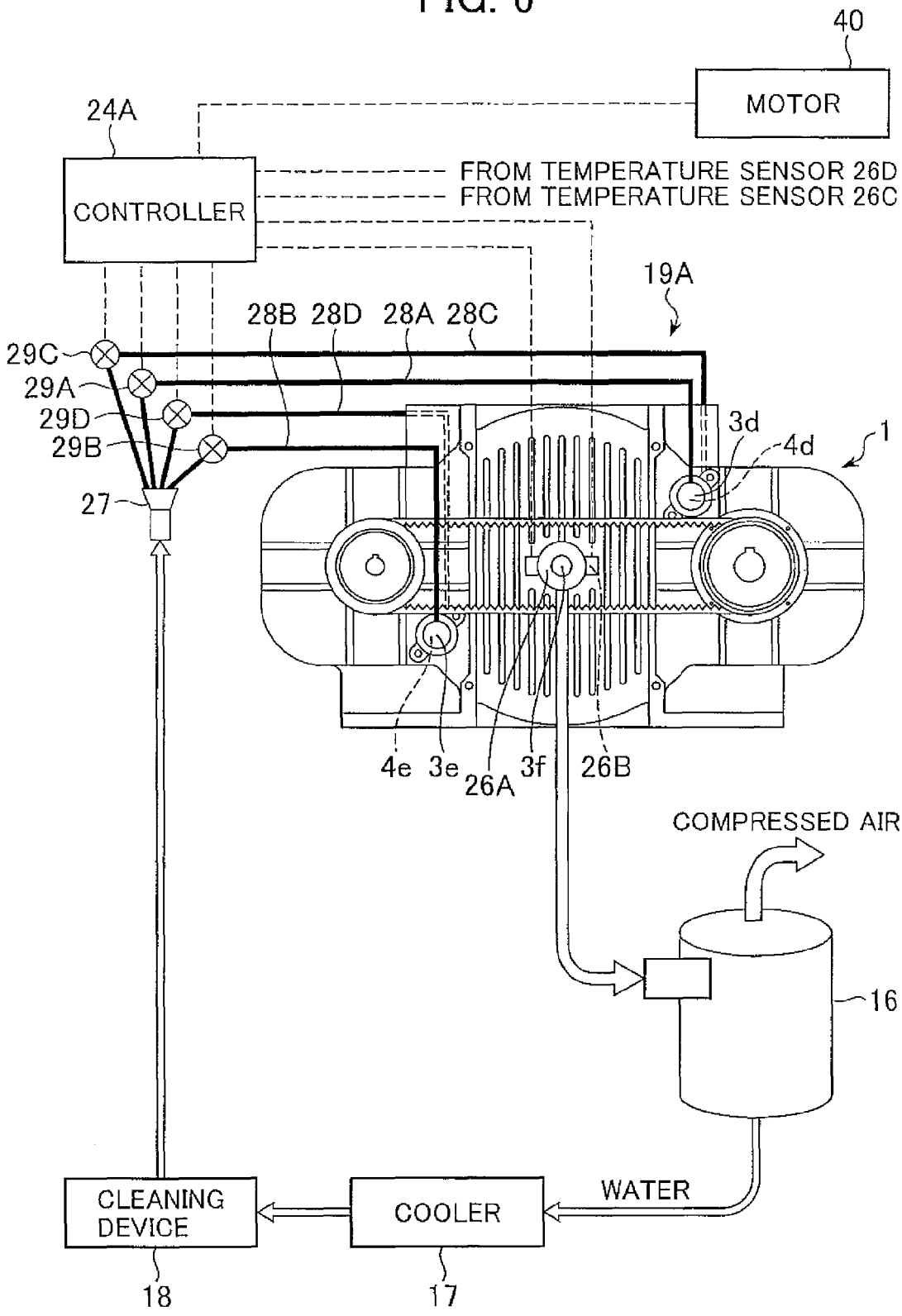
FIG. 6 is an outline diagram showing the entire configuration of an oil-free scroll compressor according to another modification of the first embodiment.
Figure 7:
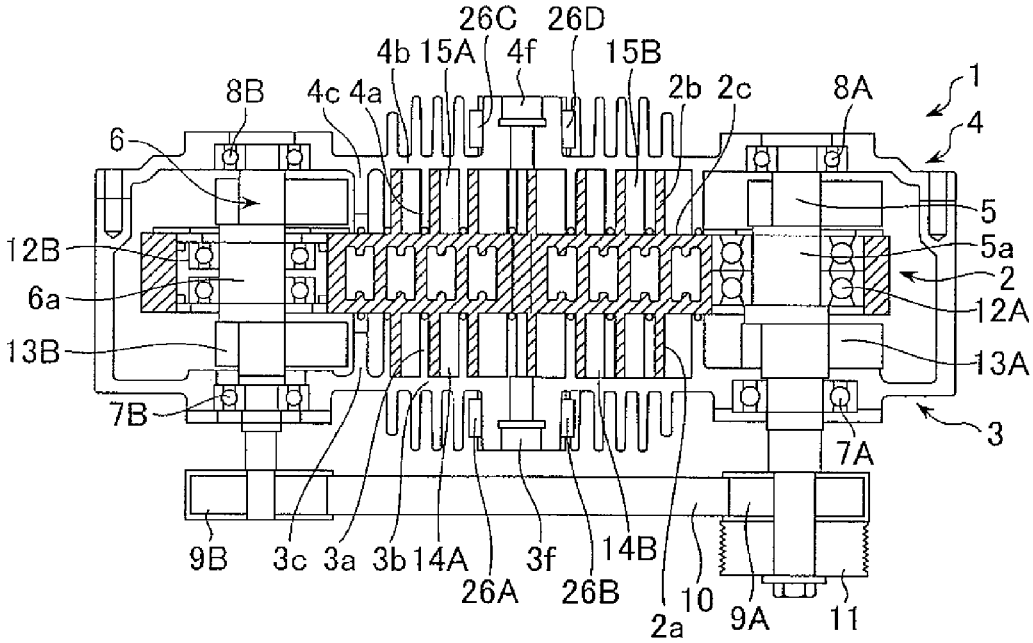
FIG. 7 is a horizontal cross sectional view of a compression body included in the oil-free scroll compressor according to the other modification of the first embodiment and temperature sensors arranged in the compression body.

FIGS. 6 and 7 show an oil-free scroll compressor according to a modification of the first embodiment. The oil-free scroll compressor according to the modification has a compressor body 1 shown in FIGS. 6 and 7. The compressor body 1 includes temperature sensors 26A, 26B, 26C and 26D and a water injector 19A. The temperature sensors 26A, 26B, 26C and 26D are adapted to detect the temperatures in the compression channels 14A, 14B, 15A and 15B and transmit signals indicative of the detected temperatures to a controller 24A (described later), respectively. The water injector 19A includes a distributor 27, injector pipes 28A, 28B, 28C and 28D, and regulating valves 29A, 29B, 29C and 29D. The distributor 27 has first to fourth outlet ports. The first outlet port of the distributor 27 is connected with the regulating valve 29A. The second outlet port of the distributor 27 is connected with the regulating valve 29B. The third outlet port of the distributor 27 is connected with the regulating valve 29C. The fourth outlet port of the distributor 27 is connected with the regulating valve 29D. The distributor 27 distributes the water supplied from the cleaning device 18 to the regulating valves 29A to 29D. The injector pipe 28A is connected with the first outlet port of the distributor 27 via the regulating valve 29A such that the water is injected from the first outlet port of the distributor 27 to the intake port 3*d*. In other words, the injector pipe 28A is connected with the first outlet port of the distributor 27 such that the water is injected from the first outlet port of the distributor 27 to the compression channel 14A. The injector pipe 28B is connected with the second outlet port of the distributor 27 via the regulating valve 29B such that the water is injected from the second outlet port of the distributor 27 to the intake port 3*e*. In other words, the injector pipe 28B is connected with the second outlet port of the distributor 27 such that the water is injected from the second outlet port of the distributor 27 to the compression channel 14B. The injector pipe 28C is connected with the third outlet port of the distributor 27 via the regulating valve 29C such that the water is injected from the third outlet port of the distributor 27 to the intake port 4*d*. In other words, the injector pipe 28C is connected with the third outlet port of the distributor 27 such that the water is injected from the third outlet port of the distributor 27 to the compression channel 15A. The injector pipe 28D is connected with the fourth outlet port of the distributor 27 via the regulating valve 29D such that the water is injected from the fourth outlet port of the distributor 27 to the intake port 4*e*. In other words, the injector pipe 28D is connected with the fourth outlet port of the distributor 27 such that the water is injected from the fourth outlet port of the distributor 27 to the compression channel 15B. The regulating valves 29A to 29D are installed to the injector pipes 28A to 28D, respectively. The water injector 19A is capable of adjusting the ratio of the amount of the water to be injected into the respective compression channels 14A, 14B, 15A and 15B to the total amount of the water to be injected into the compression channels 14A, 14B, 15A and 15B. The oil-free scroll compressor according to the modification of the first embodiment includes the controller 24A. The controller 24A receives the signals indicative of the temperatures detected from the temperature sensors 26A to 26D, calculates, based on the received signals, the opening degrees of the regulating valves 29A to 29D such that differences among the temperatures of the compression channels 14A, 14B, 15A and 15B are small, generates control signals based on the calculation, and outputs the control signals to the regulating valves 29A to 29D to control the opening degrees of the regulating valves 29A to 29D. The oil-free scroll compressor according to the modification of the first embodiment can provide the same effect as the first embodiment described above.

The second embodiment of the present invention is described below with reference to FIGS. 8 and 9. An oil-free scroll compressor according to the second embodiment has an automatic regulating valve 31 included in a water injector 19B. The same elements as those in the first embodiment are denoted by the same reference numerals, and are not described in detail.

Figure 8:
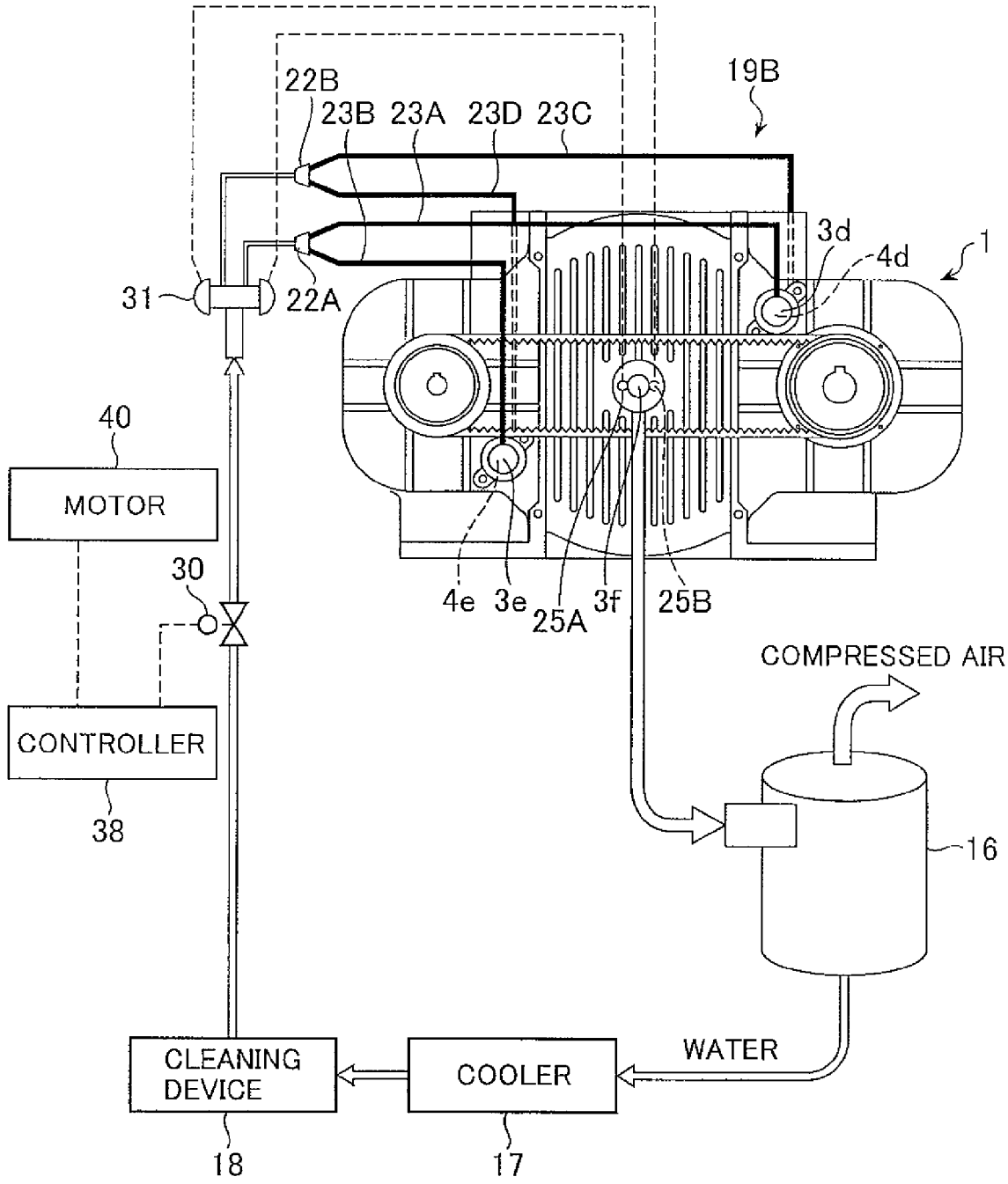
FIG. 8 is an outline diagram showing the entire configuration of an oil-free scroll compressor according to the second embodiment of the present invention.
Figure 9:
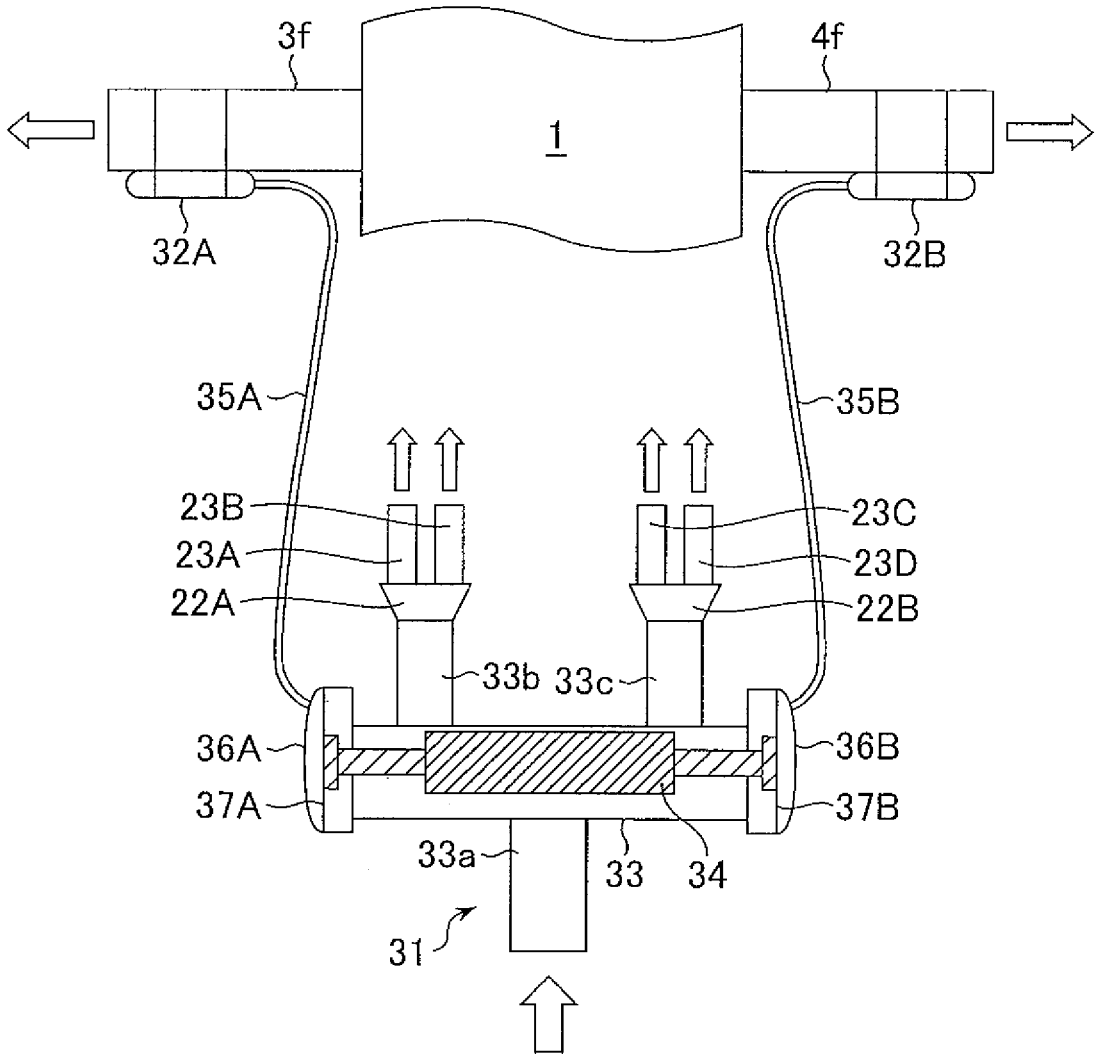
FIG. 9 is an outline diagram showing the detail structure of an automatic regulating valve according to the second embodiment.

FIG. 8 is an outline diagram showing the entire configuration of the oil-free scroll compressor according to the present embodiment. FIG. 9 is a diagram showing a detail structure of the automatic regulating valve 31.

The water injector 19B according to the present embodiment includes the automatic regulating valve 31, the distributors 22A and 22B, and the injector pipes 23A, 23B, 23C and 23D. The automatic regulating valve 31 distributes the water supplied from the cleaning device 18 via a valve 30. The automatic regulating valve 31 has outlet ports 33*b* and 33*c* (described later). The distributor 22A is connected with the outlet port 33*b* of the automatic regulating valve 31 to distribute the water, while the distributor 22B is connected with the outlet port 33*c* of the automatic regulating valve 31 to distribute the water. The injector pipe 23A is connected with one of the outlet ports of the distributor 22A such that the water is injected from the one of the outlet ports of the distributor 22A to the intake port 3*d*. The injector pipe 23B is connected with the other of the outlet ports of the distributor 22A such that the water is injected from the other of the outlet ports of the distributor 22A to the intake port 3*e*. The injector pipe 23C is connected with the one of the outlet ports of the distributor 22B such that the water is injected from the one of the outlet ports of the distributor 22B to the intake port 4*d*. The injector pipe 23D is connected with the other of the outlet ports of the distributor 22B such that the water is injected from the other of the outlet ports of the distributor 22B to the intake port 4*e*.

The oil-free scroll compressor according to the present embodiment has sensing bulbs 32A and 32B. The sensing bulb 32A in which a working gas (Flon or the like) having a low boiling point is enclosed therein is located in the vicinity of the exhaust port 3*f* of the fixed scroll member 3. The temperature of the working gas in the sensing bulb 32A changes based on the temperature (in detail, the temperature in the compression chamber located most closely to a location at which the compression chamber communicates with the exhaust port 3*f*) in the compression channel 14A, for example. Thus, the pressure level of the working gas in the sensing bulb 32A changes based on the temperature in the compression channel 14A. The sensing bulb 32B in which the working gas (Flon or the like) having the low boiling point is enclosed therein is located in the vicinity of the exhaust port 4*f* of the fixed scroll member 4. The temperature of the working gas in the sensing bulb 32B changes based on the temperature (in detail, the temperature in the compression chamber located most closely to a location at which the compression chamber communicates with the exhaust port 4*f*) in the compression channel 15B, for example. Thus, the pressure level of the working gas in the sensing bulb 32B changes based on the temperature in the compression channel 15B.

The automatic regulating valve 31 includes a tube (housing) 33, a movable bar (valve body) 34, and pressure receivers 36A and 36B. The tube 33 has an intake port 33*a* and the outlet ports 33*b* and 33*c*. The movable bar 34 is slidable in the tube 33. The pressure receiver 36A receives the working gas from the sensing bulb 32A via a capillary tube 35A. The pressure receiver 36A has a diaphragm 37A that is displaced based on the pressure level of the working gas received from the sensing bulb 32A. The pressure receiver 36B receives the working gas from the sensing bulb 32B via a capillary tube 35B. The pressure receiver 36B has a diaphragm 37B that is displaced based on the pressure level of the working gas received from the sensing bulb 32B. The diaphragm 37A is connected with one of edges of the movable bar 34, while the diaphragm 37B is connected with the other edge of the movable bar 34. Thus, the movable bar 34 slides toward a side of the outlet port 33*b* (left side of FIG. 9) or toward a side of the outlet port 33*c* (right side of FIG. 9) due to the pressure difference between the working gas introduced from the sensing bulb 32A and that introduced from the sensing bulb 32B (in other words, due to the difference between the temperature of the compression channel 14A and the temperature of the compression channel 15B) to adjust the opening degrees of the outlet ports 33*b* and 33*c*.

When the pressure level of the working gas received at the pressure receiver 36A is higher than that received at the pressure receiver 36B (or when the temperature of the compression channel 14A is higher than that of the compression channel 15B), the movable bar 34 slides toward the outlet port 33*c* due to the pressure difference to increase the opening degree of the outlet port 33*b* and reduce the opening degree of the outlet port 33*c*. This operation increases the amounts of water to be injected into the compression channels 14A and 14B and reduces the amounts of water to be injected into the compression channels 15A and 15B. When the pressure level of the working gas received at the pressure receiver 36B is higher than that received at the pressure receiver 36A (or when the temperature of the compression channel 15B is higher than that of the compression channel 14A), the movable bar 34 slides toward the outlet port 33*b* due to the pressure difference to increase the opening degree of the outlet port 33*c* and reduce the opening degree of the outlet port 33*b*. This operation increases the amounts of water to be injected into the compression channels 15A and 15B and reduces the amounts of water to be injected into the compression channels 14A and 14B. Thus, the amounts of the water to be injected are automatically adjusted such that the temperature in the compression channel 14A is the same as that in the compression channel 15B. As a result, temperature differences among the compression channels 14A, 14B, 15A and 15B are small. Thus, the oil-free scroll compressor can maintain a balance of thermal deformations and prevent the wraps from being in contact with each other.

The oil-free scroll compressor includes a controller 38 that controls the valve 30 and the motor 40 in response to an ON/OFF signal (signal instructing the oil-free scroll compressor to start or terminate an operation) received from the operation switch. When the operation switch changes from the OFF state to the ON state, the motor 40 starts operating. After that, a predetermined time elapses. The valve 30 then changes from a closed state to an opening state. When the operation switch changes from the ON state to the OFF state, the valve 30 changes from the opening state to the closed state. After that, a predetermined time elapses. The motor 40 then stops operating. Thus, the oil-free scroll compressor according to the present embodiment can prevent an excessive amount of water from remaining in the compression channels and prevent the wraps from being broken due to liquid compression.

The thus configured oil-free scroll compressor according to the present embodiment can prevent the wraps from being broken and provide improved reliability as with the first embodiment. In addition, the oil-free scroll compressor according to the present embodiment can be configured such that gaps between the orbiting scroll member 2 and the fixed scroll members 3 and 4 are small to provide improved compression performance. Furthermore, since the oil-free scroll compressor according to the present embodiment includes the automatic regulating valve 31, the cost of the oil-free scroll compressor according to the second embodiment can be reduced compared with that according to the first embodiment.

The oil-free scroll compressor of double scroll type is described above, and the present invention is applicable to the oil-free scroll compressor of double scroll type. The present invention, however, is not limited to the double scroll type. The present invention can be applied to an oil-free scroll compressor of single scroll type. Specifically, the oil-free scroll compressor of single scroll type may detect each temperature in compression channels respectively formed on the inner side and the outer side of a wrap of an orbiting scroll member, and adjust the amounts of water to be injected into the two compression channels. In this case, the same effect as described above can be obtained.

What is claimed is:

1. A scroll air compressor including an orbiting scroll member having a substantially spiral wrap, a fixed scroll member having a substantially spiral wrap corresponding to the wrap of the orbiting scroll member, and a motor that generates driving force to cause the orbiting scroll member to rotate with respect to the fixed scroll member, wherein compression channels into which water is injected are each formed between intake port and exhaust port, the scroll air compressor comprising:

temperature sensors for detecting temperatures in the compression channels;

regulating valves for controlling the amounts of water to be injected into the respective compression channels; and a controller configured to calculate a difference between the temperatures in the compression channels detected by the temperature sensors, calculate correction amounts of opening degrees of the regulating valves such that the difference between the temperatures in the compression channels detected by the temperature sensors is small, generate control signals based on the calculation, and output the control signals to the regulating valves to control the regulating valves.

2. A scroll air compressor including an orbiting scroll member having a substantially spiral wrap, a fixed scroll member having a substantially spiral wrap corresponding to the wrap of the orbiting scroll member, and a motor that generates driving force to cause the orbiting scroll member to rotate with respect to the fixed scroll member, wherein compression channels into which water is injected are each formed between an intake port and an exhaust port, the scroll air compressor comprising:

an automatic regulating valve for distributing the water through first and second outlet ports and controlling the distributing ratio of the water;

a first sensing bulb in which a first working gas is enclosed, the pressure and temperature of the first working gas changing based on one compression channel to which the water from the first outlet port of the automatic regulating valve is supplied;

a second sensing bulb in which a second working gas is enclosed, the pressure and temperature of the second working gas changing based on another compression channel to which the water from the second outlet port of the automatic regulating Valve is supplied;

wherein the automatic regulating valve includes a valve body operated due to a pressure difference between the first working introduced from the first sensing bulb and the second working gas introduced from the second sensing bulb, and wherein the valve body slides toward a side of the second outlet port to increase an opening degree of the first outlet port and reduce an opening degree of the second outlet port when the pressure of the second working gas is higher than the pressure of the first working gas, and slides toward a side of the first outlet port to increase an opening degree of the second outlet port and reduce an opening degree of the first outlet port when the pressure of the first working gas is higher than the pressure of the second working gas.

* * * * *